US009947287B2

(12) United States Patent
Lee et al.

(10) Patent No.: US 9,947,287 B2
(45) Date of Patent: Apr. 17, 2018

(54) TRANSPARENT DISPLAY DEVICE

(71) Applicant: LG DISPLAY CO., LTD., Seoul (KR)

(72) Inventors: Sanglyn Lee, Goyang-si (KR); Yeonshim Shim, Paju-si (KR); Jonghwan Park, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 23 days.

(21) Appl. No.: 14/816,798

(22) Filed: Aug. 3, 2015

(65) Prior Publication Data

US 2016/0104302 A1 Apr. 14, 2016

(30) Foreign Application Priority Data

Oct. 10, 2014 (KR) ..... 10-2014-0136909

(51) Int. Cl.
*G09G 5/00* (2006.01)
*G09G 5/02* (2006.01)
*G09G 5/10* (2006.01)

(52) U.S. Cl.
CPC ..... *G09G 5/00* (2013.01); *G09G 5/02* (2013.01); *G09G 5/10* (2013.01); *G09G 2320/0261* (2013.01); *G09G 2340/06* (2013.01); *G09G 2360/144* (2013.01)

(58) Field of Classification Search
CPC ..... G06T 11/001; G06T 2210/64; G06T 2027/0183; G06T 2027/0185; G06T 27/01; G06T 27/017
See application file for complete search history.

(56) References Cited

U.S. PATENT DOCUMENTS

| | | | | |
|---|---|---|---|---|
| 5,913,591 | A | 6/1999 | Melville | |
| 7,484,855 | B2 * | 2/2009 | Kobayashi | G03B 21/005 353/122 |
| 8,681,073 | B1 | 3/2014 | Robbins et al. | |
| 9,448,404 | B2 * | 9/2016 | Pandey | G02B 27/0172 |
| 2008/0001974 | A1 | 1/2008 | Kim et al. | |
| 2013/0147826 | A1 | 6/2013 | Lamb | |
| 2014/0132484 | A1 | 5/2014 | Pandey et al. | |
| 2017/0163937 | A1 * | 6/2017 | McNelley | H04N 7/15 |

FOREIGN PATENT DOCUMENTS

| | | | |
|---|---|---|---|
| CN | 103988234 | A | 8/2014 |
| DE | 10 2005 032 868 | A1 | 1/2007 |

* cited by examiner

*Primary Examiner* — Antonio A Caschera
(74) *Attorney, Agent, or Firm* — Birch, Stewart, Kolasch & Birch, LLP

(57) ABSTRACT

A transparent display device for compensating for external environmental effects, such as color background overlapping, interference due to external light, and the like, which have an effect on an image, provides an original image with a minimized distortion to a viewer. According to the present disclosure, one or more sensors are provided on a front surface and a rear surface of the transparent display device to detect the viewer's line of sight and background, and to compensate for a distortion of the image based on color coordinates estimated according to the detection results, thereby providing an image with higher quality.

15 Claims, 8 Drawing Sheets

TRANSPARENT DISPLAY DEVICE

CROSS-REFERENCE TO RELATED APPLICATION

Pursuant to 35 U.S.C. § 119(a), this application claims the benefit of earlier filing date and right of priority to Korean Application No. 10-2014-0136909, filed on Oct. 10, 2014, the contents of which is incorporated by reference herein in its entirety.

BACKGROUND OF THE INVENTION

1. Field of the Invention

The present disclosure relates to a transparent display device, and more particularly, to a transparent display device for minimizing external environmental effects, which have an effect on an image, such as color background overlapping, interference due to external light, and the like in order to provide an original image with no distortion to a viewer.

2. Description of the Related Art

In the flat panel display device field, studies on a transparent display device through which an image displayed on a display panel as well as an object disposed at a rear side thereof are visually recognized have been carried out.

Among flat panel display devices, in general an organic light emitting diode (OLED) display device using a spontaneous emitting element may be divided into a light emitting area and a rear reflective area, and thus it is advantageous to implement OLEDs in transparent display devices. However, a liquid crystal display (LCD) display device using an additional backlight unit, due to the non-spontaneous light emission characteristics thereof, may provide a transparent display area displayed with an image, and be affected by a background at the rear side or indirect light while displaying an image which overlaps the light emitted from the background with the image, causing the problem that the image is displayed in a color different from the intended color. Furthermore, the contrast may decrease due to an interference of indirect light, thus reducing the visibility of the image.

FIG. 1 is a view schematically illustrating various interference factors having an effect on a transparent display device in the related art.

Referring to FIG. 1, according to a transparent display device 1 in the related art, a viewer may view a background 5 located at a rear side of the transparent display device 1 while at the same time viewing an image 2 having R, G, B primary colors from a front surface of the display panel. In other words, the viewer may view an image and an object according to light (i1) due to an original image 2 displayed by the transparent display device 1 and light (i2) that has passed through the transparent display device 1 and arrived at the viewer's eyes.

However, light (i3) due to the background 5 may have an effect on the color of the original image 2 and the color of the background 5 itself may distort the original color.

Furthermore, in the transparent display device 1, there exist a front light source (FL) and a rear light source (RL) with respect to a front side of the display panel, and it may be a cause of interference or distortion with respect to light (i1, i2) from the intentional image and object.

For an example, light due to the front light source (FL) and rear light source (RL) may enter a front surface and a rear surface of the transparent display device 1 to have an effect on the hue, brightness and chroma of the background 5, thereby allowing the viewer to view distorted light (i4, i5).

Furthermore, part of the light (i6) emitted from the rear light source (RL) may distort the hue, brightness and chroma of the background 5, thereby having a direct or indirect effect on the light (i4, i5).

In other words, contrary to an existing non-transparent display device, a rear background may be visually recognized through the display panel on the transparent display device, and thus the brightness and chroma of the background may overlap and interfere with that of an original image, thereby serving as an impediment to viewing the image and object.

SUMMARY OF THE INVENTION

The present disclosure is contrived to solve or address the foregoing problems and other limitations associated with the related art, and an object of the present disclosure is to provide a transparent display device for improving the problem that an image is distorted by the environmental situation of the transparent display device by a change in color and a reduction in visibility.

In order to accomplish the foregoing and other objects, a transparent display device according to an embodiment of the present disclosure may include a display panel formed with a plurality of pixels for displaying an image, through which a background at a second side of the display panel is visible to a viewer on a first side of the display panel, one or more driving units connected to the display panel to drive the plurality of pixels, and a controller configured to control the driving unit(s).

In particular, a transparent display device according to an embodiment of the present disclosure may detect information on the external light and the background and information on a viewer's line of sight through a plurality of sensors, and receive image information from an external system providing the original image information desired for display in order to estimate the color coordinates of the transparent display device prior to and subsequent to the distortion. Through this, an image compensation unit for determining a distortion level for the color coordinates of the image in order to compensate and output a compensated image to the controller may be provided therein.

Another object of the present disclosure is to provide a transparent display device including one or more sensors to improve the viewer's line of sight and image distortion, thereby increasing the contrast ratio and enhancing the image quality.

BRIEF DESCRIPTION OF THE DRAWINGS

The accompanying drawings, which are included to provide a further understanding of the disclosure and are incorporated in and constitute a part of this specification, illustrate embodiments of the present disclosure and, together with the description, serve to explain the principles of the disclosure.

In the drawings.

DETAILED DESCRIPTION OF EMBODIMENTS

Figure 1:
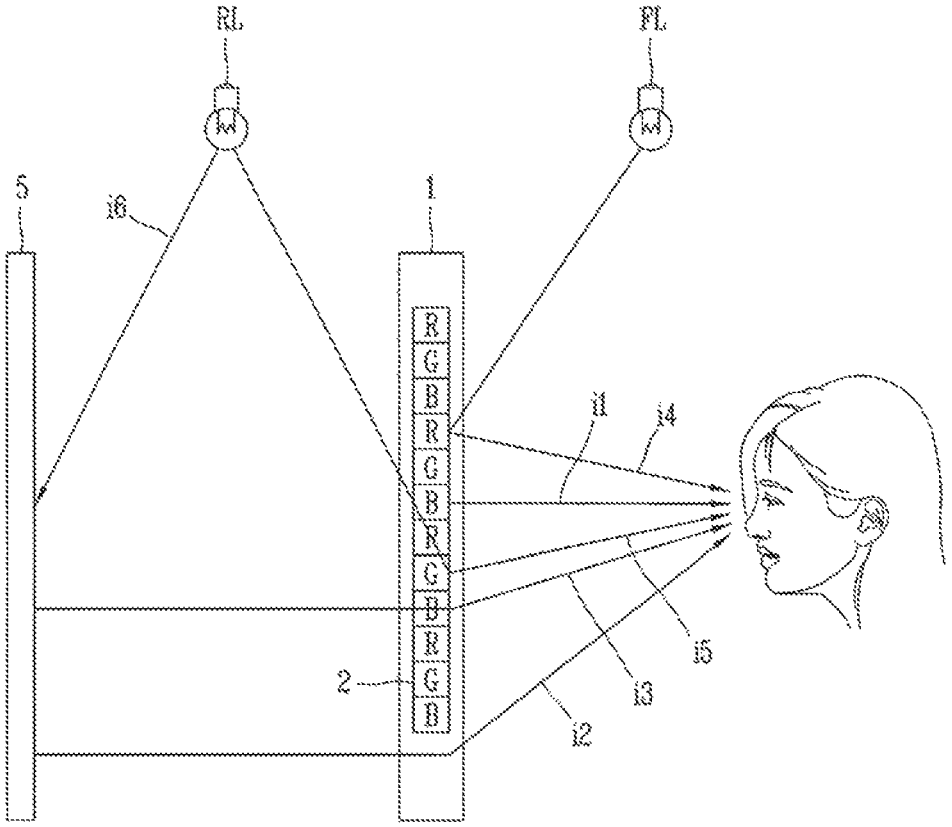
FIG. 1 RELATED ART
FIG. 1 is a view schematically illustrating various interference factors having an effect on a transparent display device in the related art.

Advantages and features of the embodiments of the present invention, and methods of accomplishing the same will be clearly understood with reference to the following embodiments described in detail in conjunction with the accompanying drawings. However, the present disclosure is not limited to those embodiments disclosed below but may be implemented in various different forms.

A shape, a size, a ratio, an angle, a number or the like disclosed in the drawings for describing an embodiment of the present disclosure may be illustrative, and thus may not be necessarily limited to the details illustrated in the present disclosure. Furthermore, like reference numerals refer to like or similar elements throughout the entire specification. In describing the embodiments of the present disclosure, the detailed description will be omitted when a specific description for publicly known technologies to which the disclosure pertains is judged to obscure the gist of the present disclosure.

When the term "comprising," "having", "consisting of," or the like is used in the present disclosure, another portion may be added unless the term "only" is used. Unless clearly indicated otherwise, expressions in the singular number include a plural meaning.

In analyzing the constituent elements, they shall be construed to include a margin of error unless clearly indicated otherwise.

The term "color" in the present disclosure may include the three attributes of color: hue, brightness and chroma.

In case of the description of a positional relationship, for example, when the term "on", "over", "below", "beside" or the like is used to explain a positional relationship of two portions, one or more other portions may be located between the two portions unless the term "immediately" or "directly" is used.

In case of the description of a temporal relationship, for example, when the term "after", "subsequent to", "then", "before" or the like is used to explain a temporal preceding and subsequent relationship, it may include a case of non-continuity unless the term "immediately" or "directly" is used.

The terms including an ordinal number such as first, second, etc. can be used to describe various elements, but the elements should not be limited by those terms. The terms are used merely for the purpose to distinguish an element from the other element. For example, a first element may be named to a second element without departing from the scope of the disclosure.

The features of various embodiments of the present disclosure, respectively, may be combined or mixed in part or entirely, and technically various interactions and operations may be available, and the embodiments, respectively, may be carried out in an independent or interactive manner to one another.

Hereinafter, a transparent display device according to a preferred embodiment of the present disclosure will be described with reference to the accompanying drawings.

Figure 2:
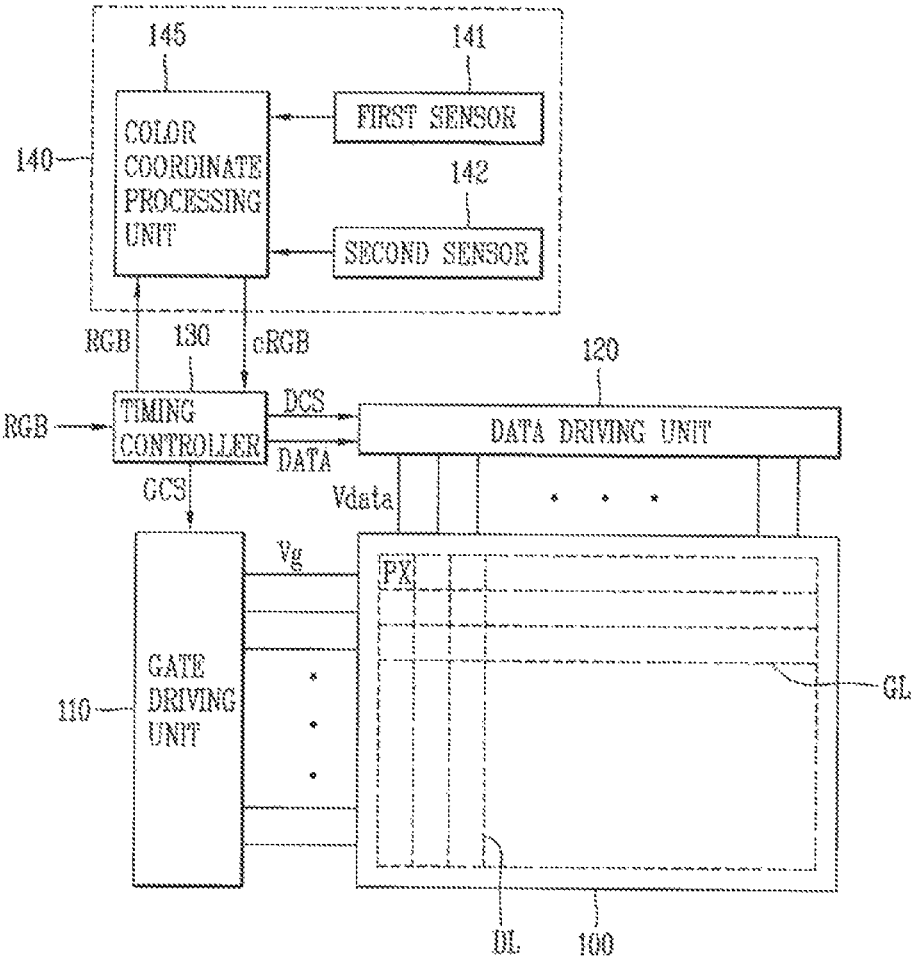
FIG. 2 is a view illustrating the structure of a transparent display device according to an embodiment of the present invention.

FIG. 2 is a view illustrating the structure of a transparent display device according to an embodiment of the present disclosure.

Referring to FIG. 2, a transparent display device according to an embodiment of the present disclosure may include a display panel 100 formed with a plurality of pixels (PXs) for displaying an image, through which a background at a rear side thereof passes, one or more driving units 110, 120 connected to the display panel 100 to drive the plurality of pixels, a timing controller 130 configured to control the driving unit 110, 120, and an image compensation unit 140 configured to determine a distortion level for the color coordinates of the image according to external light and the background to compensate and output an image signal (RGB) to the timing controller 130.

For the display panel 100, a plurality of gate lines (GLs) and a plurality of data lines (DLs) are formed in a crossed manner on a transparent substrate, and a plurality of pixels (PXs) are formed at the intersection points.

Each pixel (PX) may include three sub-pixels for R, G, B primary colors or four sub-pixels including the three primary color pixels and a white sub-pixel (W).

For such a pixel (PX), at least one thin film transistor and liquid crystal capacitor may be provided at one sub-pixel when a transparent display device is based on a liquid crystal display device, and at least one switching thin film transistor, a driving transistor, a storage capacitor and an organic light-emitting diode may be provided at one sub-pixel when based on an organic light-emitting display device. Hereinafter, the embodiments of the present disclosure will be described with reference to a liquid crystal display device.

Furthermore, for the display panel 100, two transparent substrates may be adhered to each other in a state of a liquid crystal layer being interposed therebetween, and red, green and blue color filters may be formed on either one of the substrates to implement three primary colors.

Furthermore, for a thin film transistor provided at each pixel (PX) of the display panel 100, a gate electrode is connected to a gate line (GL), and a source electrode is connected to a data line (DL). Furthermore, a drain electrode is connected to a pixel electrode facing a common electrode. For a material constituting an active layer of the thin film transistor, amorphous silicon (a-Si silicon), poly silicon or the like may be used, and silicon oxide having an enhanced mobility characteristic may be also used when high performance is required for an element, due to the trend of large size and high-image quality.

A gate driving unit 110 may include a plurality of thin film transistors either formed in a non-display area excluding the pixel region of the display panel 100, or provided with a separate driving IC and connected to the display panel 100. The gate driving units 110 may be provided at both sides of the display panel 100 in a large size and high-resolution liquid crystal display device.

In particular, the gate driving unit 110 outputs a driving signal (Vg) at a high level for each horizontal period (1H) through the gate line (GL) formed on the display panel 100 in response to a gate control signal (GCS) received from the timing controller 130. Accordingly, a thin film transistor within the pixel (PX) is conducted in the unit of horizontal lines, and a data signal (Vdata) is output through the data line (DL) in synchronization therewith and charged to the liquid crystal capacitor to display an image with a different light transmittance of liquid crystals.

The gate control signal (GCS) may include a gate start pulse (GSP), a gate shift clock (GSC) and a gate output enable (GOE), and the like.

The data driving unit 120 converts aligned image data (DATA) in a digital format to a data voltage (Vdata) in an analog format according to a reference voltage in response to a data control signal (DCS) received from the timing controller 130. Furthermore, the data driving unit 120 latches the converted analog data voltages (Vdata) for each horizontal line to output them at the same time to the display panel 100 through all data lines (DLs) for each horizontal period (1H).

The data control signal (DCS) may include a source start pulse (SSP), a source shift clock (SSC), a source output enable (SOE), and the like.

Here, the aligned image data (DATA) is image data in which image information calculated and compensated with a distortion component to one or more images for the environmental situation of the transparent display device is used as a source and the calculated correction value is reflected by an image compensation unit 140 which will be described later. The aligned image data can also be referred to as compensated image data.

Accordingly, a data voltage (Vdata) output by the data driving unit 120 is compensated with a distortion component, and a viewer may view a compensated image close to an original image when an image due to the data voltage (Vdata) is overlapped with light due to the background. A method of calculating the correction value is implemented by the image compensation unit 140, and the detailed description thereof will be described later.

The timing controller 130 receives a timing signal (Ts) from an external system (not shown) to generate the control signals (GCS, DCS) of the gate driving unit 110 and data driving unit 120 in response to the timing signal, and receives an image signal (RGB) and provides it to the image compensation unit 140 to receive a compensated image signal (cRGB) for which a color distortion due to the background has been compensated, and then provides its aligned data (DATA) to the data driving unit 120.

The image compensation unit 140 may include one or more sensors 141, 142, and a color coordinate processing unit 145, and compensate an image signal (RGB) transmitted from the timing controller 130 according to the environmental situation sensed through each sensor 141, 142 and then transmit it again to the timing controller 130.

It is to compensate for a distortion due to the variation of a color coordinate when an image due to original image information (RGB) is overlapped with ambient light, particularly, a background located at a rear surface of the transparent display device. Accordingly, preferably the sensors 141, 142 should be configured with a first sensor 141 for sensing in which direction at least the viewer's line of sight is currently located and a second sensor 142 for sensing the hue, brightness and chroma of the background. An auxiliary sensor may be further provided to enhance the accuracy of the compensation result.

The foregoing color coordinate processing unit 145 estimates a conversion parameter of the image to calculate a transformed color coordinate according to the sensing result of the first and the second sensors 141, 142, and compares the color coordinate of an original image with the transformed color coordinate to generate compensation data. The color coordinate processing unit 145 may be implemented with a separate IC or integrated into one IC within the timing controller 130.

Accordingly, a transparent display device according to the present disclosure may improve a problem that the color of an image is distorted by a background color according to the characteristic of the transparent display device, the present disclosure thereby having the effect of more accurately providing an originally intended image.

Hereinafter, an image compensation unit according to an embodiment of the present disclosure will be described in more detail with reference to the accompanying drawings.

Figure 3:
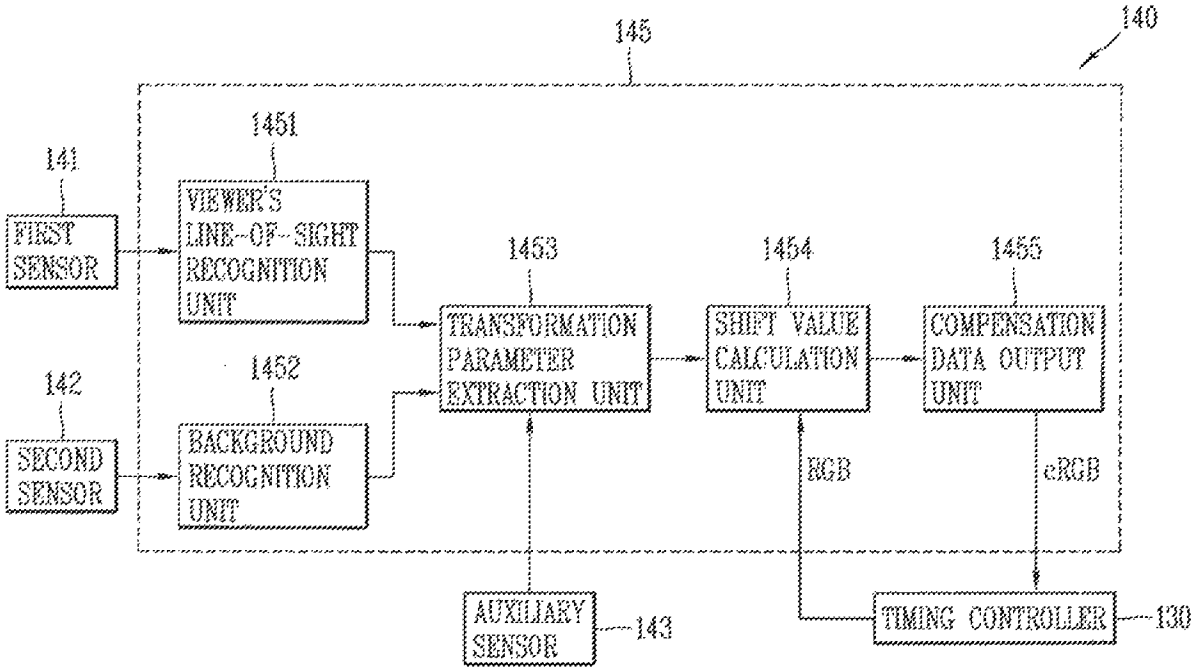
FIG. 3 is a view illustrating the configuration of an image compensation unit according to an embodiment of the present invention.

FIG. 3 is a view illustrating the configuration of an image compensation unit according to an embodiment of the present disclosure, and FIGS. 4 through 6B are views for explaining a method of generating compensation data with the image compensation unit. In the following description, it will be described with reference to FIG. 3 along with FIGS. 4 through 6B.

First, referring to FIG. 3, the image compensation unit 140 according to an embodiment of the present disclosure may include a first sensor 141 configured to track a viewer's line of sight, a second sensor unit configured to sense the external light and background, and a color coordinate processing unit 145 configured to calculate a conversion parameter of the image to estimate transformed color coordinates according to a sensing result of the first and the second sensor, and compare the color coordinates of an original image and the transformed color coordinates to generate compensation data.

The first sensor 141 captures toward which region of the display panel a viewer's line of sight is currently directed to provide it to a viewer's line-of-sight recognition unit 1451 of the color coordinate processing unit 145. Accordingly, the first sensor 141 may be provided toward a front side of the transparent display device to capture the viewer's eyes to detect a position of the viewer, a distance between the transparent display device and the viewer, and line-of-sight information on the viewer's pupils.

The second sensor 142 captures the background and indirect light of the transparent display device to provide them to a background recognition unit 1452 of the color coordinate processing unit 145. To this end, the second sensor 142 may be provided toward a rear side of the transparent display device to detect background information on the hue, brightness and chroma of the background.

On the other hand, a separate auxiliary sensor 143 may be further provided to enhance the compensation accuracy of a current image in addition to the line-of-sight information and background information. Overlapping between an image and a background on the display panel may be a key element having an effect on an image recognized by the viewer, but an interference with the color of an image on the display panel due to external light in addition to that may be further taken into consideration to calculate more accurate compensation data. The auxiliary sensor 143 captures a front surface of the transparent display device to reflect an additional image distortion element on the calculation of compensation data.

The first and the second sensor 141, 142 are connected to the color coordinate processing unit 145. The color coordinate processing unit 145 may include a viewer's line-of-sight recognition unit 1451 configured to derive a color coordinate corresponding to a viewer's line of sight tracked by the first sensor 141, a background recognition unit 1452 configured to derive a color attribute for the external light and background sensed by the second sensor 142, a transformation parameter extraction unit 1453 configured to extract a transformation parameter due to the external light and background from an image sensed on the image coordinate, a shift value calculation unit 1454 configured to compare a reference color coordinate and a color coordinate due to the transformation parameter to calculate a shift value, and a compensation data output unit 1455 configured to apply the shift value to a subject pixel to generate the compensation data.

The viewer's line-of-sight recognition unit 1451 receives line-of-sight information from the first sensor 141, and determines a coordinate value (x, y) on the display panel at which the user's line of sight is located in response to this.

Furthermore, the background recognition unit 1452 receives background information from the second sensor 142, and derives the generated hue, brightness and chroma of the background.

Figure 4:
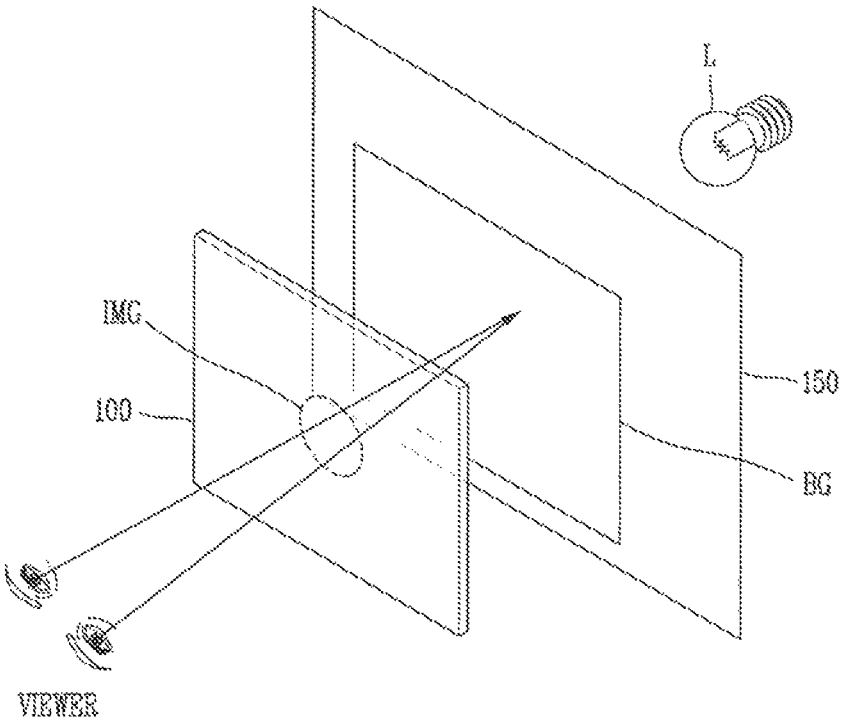
FIGS. 4 through 6B are views for explaining a method of generating compensation data due to the image compensation unit according to an embodiment of the present invention.

Referring to FIG. 4, the viewer of the transparent display device in one example views a region in which an image (IMG) displayed on one region of the display panel 100 is overlapped with a background (BG) of the display panel 150, and accordingly, the viewer views an image and background in which the hue, brightness and chroma of the image (IMG) and the hue, brightness and chroma of the background (BG) are overlapped and the color of the image (IMG) and (BG) is changed by background light (L). Here, there occurs a difference of color distortion level in the image (IMG) and background (BG) according to a distance between the viewer and the display panel 100 and the viewer's line of sight. As a result, the viewer's line-of-sight recognition unit 1451 determines a user's distance and an image coordinate (x, y) of the display panel 100 indicated by the viewer's line of sight through line-of-sight information, and the background recognition unit 1452 derives color information due to the background (BG) and background light (L).

The transformation parameter extraction unit 1453 extracts a transformation parameter due to the color of a background with respect to an image on the viewer's line of sight through the image coordinate (x, y) and color information from the viewer's line-of-sight recognition unit 1451 and background recognition unit 1452.

Figure 5A:
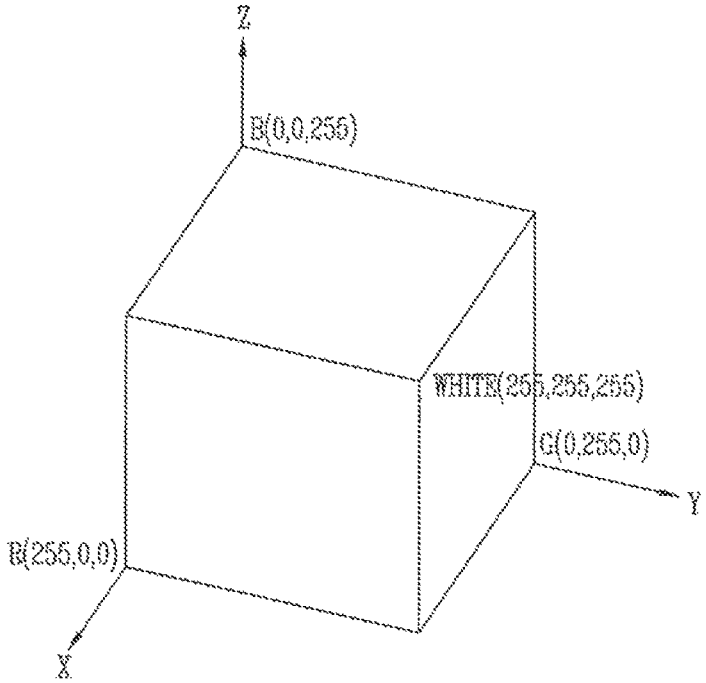

Specifically, when the display device according to an embodiment of the present disclosure implements 255 gradations, for a color space of the device, x, y, z coordinates correspond to red (R), green (G) and blue (B), respectively, as illustrated in FIG. 5A, and a desired color is carried out according to the mixture of 0 to 255 values for R, G, B primary colors. When the display device implements full white, values for R, G, B gradations are set 255, 255 and 255, respectively.

Figure 5B:
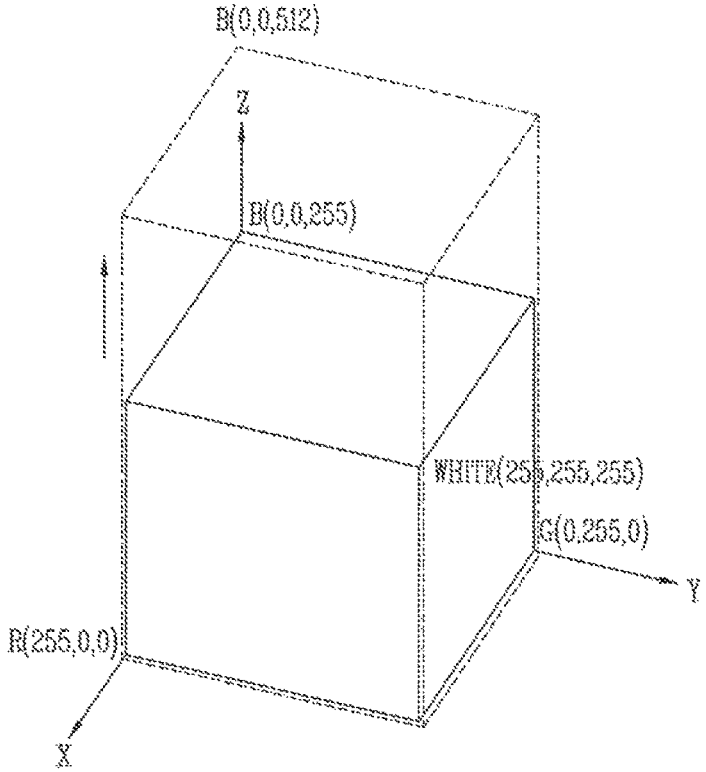
Figure 6A:
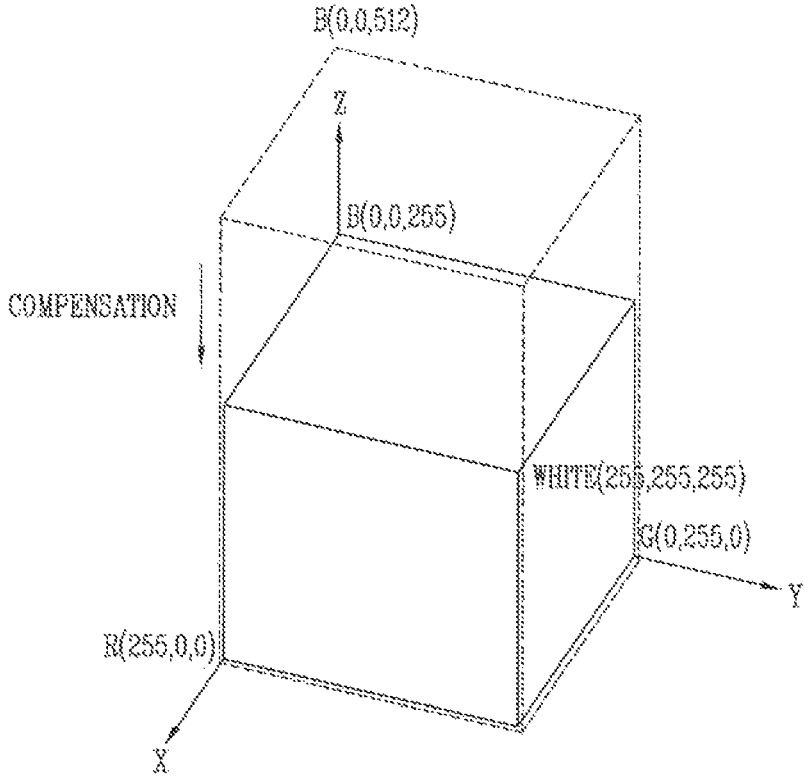

As a view in which a color displayed in R, G, B gradations is substituted into x, y, z coordinates, FIGS. 5A, 5B and 6A illustrate views in which x, y, z indicate gradations for R, G, B colors, respectively.

In other words, x, y, z indicate values for R, G, B gradations, respectively, and the relevant pixel displays a light closer to red when increasing the x-value, and displays a light closer to green when increasing the y-value. Furthermore, the pixel displays a light closer to blue when increasing the z-value. Accordingly, the relevant pixel displays full black when x, y, z values are 0, 0, 0, and displays full white when x, y, z values are 255, 255, 255. In other words, each pixel of the display device displays a color according to the value within a rectangular range formed by x, y, z values on the drawing.

On the other hand, the color space has different coordinates due to the external light and background color in case of a transparent display device. In other words, even when 255, 255, 255 are given to the R, G, B pixels for their gradations values to display full white, a color recognized by the viewer's eyes in actuality may be not be full white. For an example, even though the transparent display device displays full white when the background is blue, the viewer sees a bluish color. In other words, a color space for the actual image is transformed.

The transformation form of such a color space may be divided into different forms of transformation: scaling, in which each of the range of gradation values for red, blue and green each decreases or increases in a consistent and constant manner; distortion in which the gradation values for red, blue and green each vary a different amount and therefore the overall effect is to skew the color space in an irregular manner; or offset, in which a start and an end coordinate of the gradation value vary and the color space is translated. Other forms or combinations of the transformation may be used.

The transformation parameter extraction unit 1453 performs the role of extracting a transformation parameter according to the transformation form of such a color space, thereby determining pixels corresponding to a region indicated by the viewer's line of sight according to line-of-sight information, and extracting a transformation level of gradation value for the relevant pixels due to the external light and background color derived by background information. When divided according to the transformation form of a color space, a transformation parameter may be calculated by a predetermined pattern that changes a gradation value, thereby effectively obtaining a transformation parameter.

In the above example, as illustrated in FIG. 5B, it is seen that a range of B gradation value increases for a blue background. In other words, an original color space is changed to a transformed color space (trans), wherein a z-axis value of the color space of the transparent display device becomes above 255 (~512). As a result, in order to provide accurate full white to the viewer, the actual gradation value of the pixel should be reduced to below at least 255 according to the background color.

The shift value calculation unit 1454 receives a transformation parameter of the transparent display device calculated based on an image distorted by the background color, and an original image signal received from an external system (not shown) or the timing controller 130, and estimates a color coordinate due to their transformation and a color coordinate that is a reference on which the original characteristic of the transparent display device is reflected. The original image signal can also be referred to as original image data.

Then, the shift value calculation unit 1454 compares differences between an original color coordinate and a transformed color coordinate according to the color coordinate estimation to calculate a compensation value for compensating an image signal and then provide it to the compensation data output unit 1455.

Figure 5C:
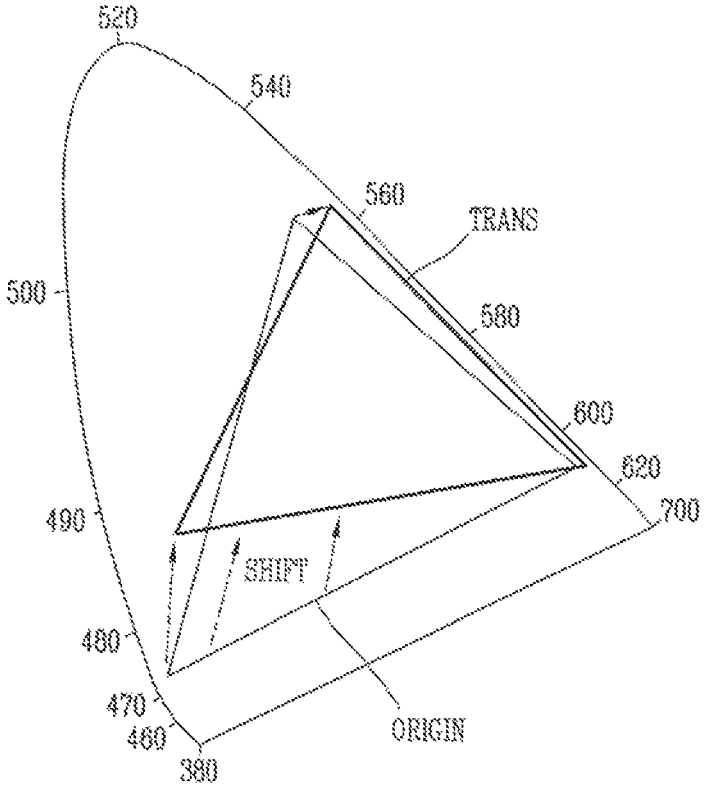

Referring to FIG. 5C, when the background is white on a color coordinate in which a color space is shown as a distribution chart, a color coordinate (origin) according to an original characteristic of the transparent display device and a color coordinate (trans) transformed by a colored background of the transparent display device are deviated from each other. FIG. 6A illustrates an example in which a blue line of the color coordinates (origin) of an original transparent display device is shifted. Accordingly, a shift amount of the transformed color coordinate (trans) may be obtained, and its reverse shift may be taken to reflect the original image information (RGB), thereby obtaining compensated image information (cRGB) adjusted to an original color coordinate.

The compensation data output unit 1455 performs the role of applying a reverse shift amount calculated from the shift value calculation unit to the original image information (RGB) to calculate compensated image information (cRGB), and provide it to the timing controller 130.

Figure 6B:
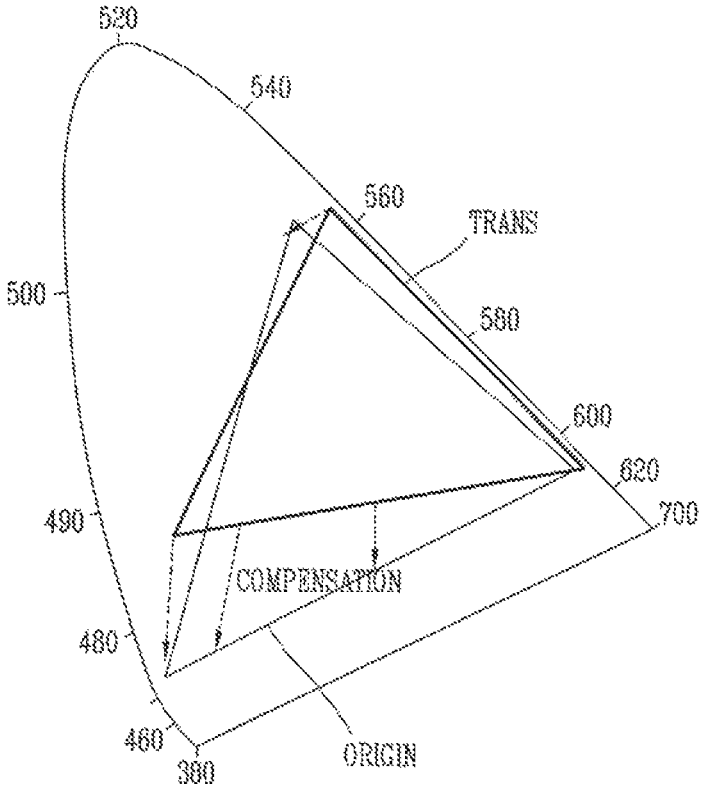

FIGS. 6A and 6B illustrate a color space and a color coordinate for a compensated image. Referring to the drawings, the color space of a color currently displayed by the transparent display device according to an embodiment is transformed by a shift value contrary to the original color space, and moved by a compensation value corresponding to the shift value to the original image information (RGB) to perform a compensated image information (cRGB). Accordingly, the transformed color coordinate (trans) is reversely moved to the original color coordinate (origin) to allow the viewer to recognize a currently displayed image to be the same as the original image.

According to such a structure, a transparent display device according to the embodiments of the present disclosure (invention) may detect a viewer's line of sight and a background color, and estimate a color coordinate in order to perform compensation, thereby having an effect of providing an image with a minimized distortion.

Although embodiments of the present disclosure have been described with reference to the embodiments as illustrated in the drawings, these are merely illustrative, and it should be understood by those skilled in the art that various modifications and equivalent other embodiments of the present disclosure can be made.

What is claimed is:

1. A transparent display device, comprising:

a display panel comprising a plurality of pixels configured to display a compensated image to a viewer facing a first side of the display panel, wherein at least part of a background facing a second side of the display panel is visible to the viewer through the display panel at least when no image is being displayed by the display panel;

means for compensating an image being displayed on the display panel in order to remove distortion of the image due to interference by the background visible through the display panel in a region of the display panel where light from the background overlaps the image in order to provide an originally intended image, the means for compensating the image comprising:

a position sensor provided toward the first side of the display panel for determining the viewer's position including a variable distance from the viewer to the display panel; and means for determining, based on the sensed position of the viewer, which part of the background corresponds to the at least part of the background visible to the viewer through the display panel, the means for compensating the image being configured to:

determine a distortion level of the image according to an external light and the light from the background corresponding to the variable distance from the viewer to the display panel, including determining a property of the background, wherein the determined property of the background is a determined property of the at least part of the background visible to the viewer through the display panel, and wherein the determined property includes color, and process original image data to compensate for the distortion level of the image, thereby producing compensated image data; and means for generating a display by the display panel of the compensated image, the compensated image being based on the compensated image data.

2. The transparent display device of claim 1, wherein the position sensor is a camera.

3. The transparent display device of claim 1, wherein the means for compensating the image comprises:

a background sensor provided toward the second side of the display panel and configured to determine the property of the background.

4. The transparent display device of claim 3, wherein the background sensor is a camera.

5. The transparent display device of claim 3, wherein the means for compensating the image comprises:

means for calculating transformed color coordinates according to a sensing result of the background sensor, wherein processing the original image data comprises comparing original color coordinate of the original image data and the transformed color coordinates.

6. The transparent display device of claim 1, wherein the means for compensating the image comprises:

means for deriving a color coordinate corresponding to a viewer's line of sight determined using a position sensor;

means for deriving a color attribute for the background using a background sensor;

means for calculating transformed color coordinates based on the color attribute for the background with respect to the color coordinates;

means for comparing original color coordinates and the transformed color coordinates to calculate a shift value; and means for applying the shift value to respective pixels of the original image data to generate the compensated image data.

7. The transparent display device of claim 6, wherein the means for calculating the transformed color coordinates is communicatively coupled to an auxiliary sensor configured to sense a surface of the first side of the display panel to provide the color attribute of the background when seen from the first side of the display panel.

8. The transparent display device of claim 5, wherein the means for calculating the transformed color coordinates is configured to divide the original image data into any one of transformation formats of scaling, distortion and offset.

9. The transparent display device of claim 1, wherein, when the compensated image is being displayed, the viewer can simultaneously see the displayed image and the at least part of the background through the display panel.

10. The transparent display device of claim 1, wherein, when the compensated image is being displayed, the viewer cannot see the at least part of the background through the display panel.

11. The transparent display device of claim 1, wherein the determined property of the background includes light intensity.

12. A transparent display device, comprising:

a display panel comprising a plurality of pixels configured to display a compensated image to a viewer facing a first side of the display panel, wherein at least part of a background facing a second side of the display panel is visible to the viewer through the display panel at least when no image is being displayed by the display panel;

an image compensating unit for compensating an image being displayed on the display panel in order to remove distortion of the image due to interference by the background visible through the display panel in a region of the display panel where light from the background overlaps the image in order to provide an originally intended image, the image compensating unit comprising:

a position sensor provided toward the first side of the display panel and configured to determine the viewer's position including a variable distance from the viewer to the display panel; and a determination unit configured to determine, based on the sensed position of the viewer, which part of the background corresponds to the at least part of the background visible to the viewer through the display panel, the image compensating unit configured to:

determine a distortion level of the image according to an external light and the light from the background corresponding to the variable distance from the viewer to the display panel, including determining a property of the background, wherein the determined property of the background is a determined property of the at least part of the background visible to the viewer through the display panel and wherein the determined property includes color, and process original image data to compensate for the distortion level of the image, thereby producing compensated image data; and a generating unit configured to generate a display by the display panel of the compensated image, the compensated image being based on the compensated image data.

13. The transparent display device of claim 12, wherein the position sensor is a camera.

14. The transparent display device of claim 12, wherein the image compensating unit comprises:

a background sensor provided toward the second side of the display panel and configured to determine the property of the background.

15. The transparent display device of claim 14, wherein the background sensor is a camera.

* * * * *